US006243617B1

(12) United States Patent
Crowley

(10) Patent No.: US 6,243,617 B1
(45) **Date of Patent: *Jun. 5, 2001**

(54) SYSTEM AND METHOD FOR INCORPORATION OF POST-PRODUCTION OPERATIONS TO A WEB OUTPUT FROM AN IMAGE TRANSFER DEVICE

(75) Inventor: H. W. Crowley, Newton, MA (US)

(73) Assignee: Roll Systems, Inc., Burlington, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/135,281

(22) Filed: Aug. 17, 1998

Related U.S. Application Data

(60) Continuation of application No. 08/481,740, filed on Jun. 7, 1995, now Pat. No. 5,794,830, which is a division of application No. 08/296,127, filed on Aug. 25, 1994, now Pat. No. 5,538,171, which is a division of application No. 07/848,039, filed on Mar. 9, 1992, now Pat. No. 5,344,057, which is a division of application No. 07/560,127, filed on Jul. 31, 1990, now Pat. No. 5,193,727.

(51) Int. Cl.[7] ..... G06E 19/00
(52) U.S. Cl. ..... 700/122
(58) Field of Search ..... 700/122; 226/24, 226/27, 108, 112

(56) References Cited

U.S. PATENT DOCUMENTS

| | | | | |
|---|---|---|---|---|
| 3,650,205 | * | 3/1972 | Wybrow et al. . | |
| 3,908,542 | * | 9/1975 | Anderson | 400/583.3 |
| 4,025,025 | * | 5/1977 | Bartel et al. . | |
| 4,027,142 | * | 5/1977 | Paup et al. . | |
| 4,485,982 | * | 12/1984 | St. John et al. . | |
| 4,532,596 | * | 7/1985 | Pugsley . | |
| 4,633,395 | * | 12/1986 | Kuefuss . | |
| 4,677,551 | * | 6/1987 | Suganuma . | |
| 4,757,930 | * | 7/1988 | Ditto | 226/27 |
| 4,768,410 | * | 9/1988 | Wood | 400/583.3 |
| 4,843,959 | * | 7/1989 | Rendell . | |
| 4,898,094 | * | 2/1990 | Duomoto et al. | 226/4 |
| 4,903,600 | * | 2/1990 | Long . | |
| 4,945,252 | * | 7/1990 | Lerner et al. | 226/2 |
| 4,982,887 | * | 1/1991 | Takahashi . | |
| 5,067,835 | * | 11/1991 | Yamamoto et al. . | |
| 5,076,718 | * | 12/1991 | Sugino | 400/583.3 |
| 5,193,727 | * | 3/1993 | Crowley | 226/24 |
| 5,216,444 | * | 6/1993 | Noguchi et al. . | |
| 5,344,057 | * | 9/1994 | Crowley | 226/2 |
| 5,538,171 | * | 7/1996 | Crowley | 226/2 |
| 5,794,830 | * | 8/1998 | Crowley | 226/24 |

FOREIGN PATENT DOCUMENTS

| | | | |
|---|---|---|---|
| 3833731 | * | 4/1990 | (DE) . |
| 0067957 | * | 12/1982 | (EP) . |
| 0264347 | * | 4/1988 | (EP) . |
| 0308984 | * | 3/1989 | (EP) . |
| 1044535 | * | 10/1966 | (GB) . |
| 59-00578 | * | 4/1984 | (JP) . |
| PCT91/19957 | * | 12/1991 | (WO) . |

* cited by examiner

*Primary Examiner*—Thomas M. Heckler
(74) *Attorney, Agent, or Firm*—Cesari and McKenna, LLP; William A. Loginov

(57) ABSTRACT

A system and method for incorporating, in the production of a continuous stream of images, by an image transfer device upon a moving web, post-production operations upon the web at various locations. Locations of a web, having a plurality of images placed thereon, output from an image transfer device are tracked. Specific operations at various locations upon the web are performed by a post-production device as the web passes through it. The web is directed from the image transfer device to the post-production device. In response to the tracking of locations upon the web, the point when a location has entered the post-production device is determined. In response to this determination, the post-production device is commanded to perform its specific operation at a connect location.

4 Claims, 5 Drawing Sheets

SYSTEM AND METHOD FOR INCORPORATION OF POST-PRODUCTION OPERATIONS TO A WEB OUTPUT FROM AN IMAGE TRANSFER DEVICE

RELATED APPLICATIONS

This is a continuation of copending U.S. patent application Ser. No. 08/481,740, filed Jun. 7, 1995, now U.S. Pat. No. 5,794,830, which is a divisional of copending U.S. patent application Ser. No. 08/296,127, filed Aug. 25, 1994, now U.S. Pat. No. 5,538,171, which is a division of copending U.S. patent application Ser. No. 07/848,039, filed Mar. 9, 1992, now U.S. Pat. No. 5,344,057, which is a division of copending U.S. patent application Ser. No. 07/560,127, filed Jul. 31, 1990, now U.S. Pat. No. 5,193,727.

FIELD OF THE INVENTION

This invention relates to a unique system and method for performing a post-production operation upon a web subsequent to its output from an image transfer device.

BACKGROUND OF THE INVENTION

It is often desirable in a printing process involving a continuous stream of images laid down upon a moving paper web to incorporate other post-production processes to the web downstream of the printing process. These post-production processes may include, for example, page or job separation, hole punching, color logo application or folding operations. The problem with performing such post-production processes or operations is that the web transferred between the image and the post-production machines may not contain standard length pages or may otherwise have pages in locations upon the web that are difficult to gauge. Thus, the post-processing device must have some means for accurately locating each page presented to it, and furthermore, once each page location is found, must have a means of distinguishing between each individual page sent to it to determine which page must include a given post-production operation.

An additional problem with keeping track of processed pages as they are transferred to a post-production device is that the two devices may run at unsynchronized speeds, especially where they are discrete and separate units. As such, slack may develop in the transfer loop of web between the two devices, resulting in more images en route than expected and potential misapplication of the post-production operation.

SUMMARY OF THE INVENTION

It is, therefore, an object of the present invention to provide a unique system and method for allowing post-production operations to be performed on a moving web containing images wherein the image production element and the post-production device may not be synchronized in their feeding of the web.

It is another object of this invention to provide a system and method for incorporating post-production operations that accurately locates the point upon the web at which the post-production operation is to be applied.

It is another object of this invention to provide a system and method for incorporating post production operations that allows the tracking of various locations upon a moving web to accurately perform a multiplicity of types of post-production operations at these various locations.

It is yet another object of this invention to provide a system and method for incorporating post-production operations that allows the tracking of pages and images placed upon a moving web wherein the pages and images are of variable length.

This invention provides a system for incorporation, in the production of continuous stream of images by an image transfer device upon a moving web, post-production operations upon the web at various web locations. There are means for tracking locations of a web, having a plurality of images placed thereon, output from an image transfer device. There are post-production means to perform a specific operation at locations of the web upon its passing through the post-production means. There are also means for directing the web from the image transfer device to the post-production means. There are means, responsive to the means for tracking, for determining when the location has entered the post-production means, and there are also means responsive to these determining means for commanding the post-production means to perform its specific operation at the location.

In a preferred embodiment, the means for tracking also includes means for generating a pulse each time a interval of web is output from the image transfer device. This means for generating may include means for combining a plurality of pulses to indicate the output from the image transfer device of a page length of web. The post-production means may include means for creating an electronic mark each time one of the intervals of the web passes through the post-production means. This means for creating may include page identification means that indicates, by means of counting the electronic marks, the passing of the page length or certain image of the web through the post-production means.

The determining means may further include counter means that increments a stored value for each page indicated by the means for combining, and decrements the stored value for each page indicated by the page identification means. This stored value is a total length value equaling the number of page lengths upon the web disposed between the image transfer device and the post-production means when the web is pulled taut with relatively no slack thereon. The determining means may further include a register means, responsive to the counter means, to store first through last data blocks equal in number to at least a current value contained in the counter means. Each of the data blocks directly corresponds to a page length disposed between the image transfer device and the post-production means and each of the data blocks contains a data value representative of a post-production operation to be performed upon the web at the page length. The last of the data blocks contains a data value corresponding to the page length increment currently entering the post-production means. The register means may include a shifting means that adds a new data value, deletes a data value, or moves values in data blocks to correspond directly to the movement of each page length increment upon the web from the image transfer device to the post-production means.

In an alternative embodiment, the determining means may including storage register means having a number of storage locations to each store a data value corresponding to the number of intervals between each of the locations upon which the specific post-production operation is to be performed. This storage register means may also include means for monitoring the total number of intervals of the web currently disposed between the image transfer device and the post-production means.

In yet another embodiment, a storage register means may also have a number of storage locations to consecutively store first through last data values corresponding to the number of page length increments between each of the locations upon which a specific post-production operation is to be performed. This storage register may also include a means for structuring a number of storage locations; equal to the maximum number of page lengths upon the web that may be disposed between the image transfer device and the post-production means. This storage register may further include a means for comparing a last data value stored in the storage register to the number of pages successively indicated by the page identification means. This allows the means for comparing to indicate when a correct location has entered the post-production means. There may be a means for moving data values, in response to the comparing means, within the storage register means to add a new data value to the storage register and to delete last data values from the storage register. This means for structuring may include a means for calculating the number of page lengths on the web currently disposed between the image transfer device and the post-production means.

The post-production means may generally include, among other devices, a folder, job separator, printing device, hole punching device, or web cutting device. Additionally, the image transfer device may include among its elements an electronic printer such as a laser, impact or other type capable of the production of variable page length images.

A method for incorporating, in the production of a continuous stream of images by an image transfer device upon a moving continuous web, post-production operations upon the web at various locations is also provided. Such a method would generally include the steps of tracking the locations of a web, having a plurality of images placed thereon, output from the image transfer device. There would also be provided a step of performing, with a post-production means, a specific operation at each of the locations on the web upon its passing through the post-production means. In another step, the web is then directed from the image transfer device to the post-production means. In response to the tracking step, the time when a correct location has entered the post-production means is then determined. The method further includes the step of commanding the post-production means, in response to the determination of the point when the correct location has entered the post-production means, to perform its specific operation at the correct location.

BRIEF DESCRIPTION OF THE DRAWINGS

The foregoing objects and advantages of the present invention will be more clearly understood in connection with the accompanying drawings in which.

DETAILED DESCRIPTION OF THE PREFERRED EMBODIMENTS

Figure 1:
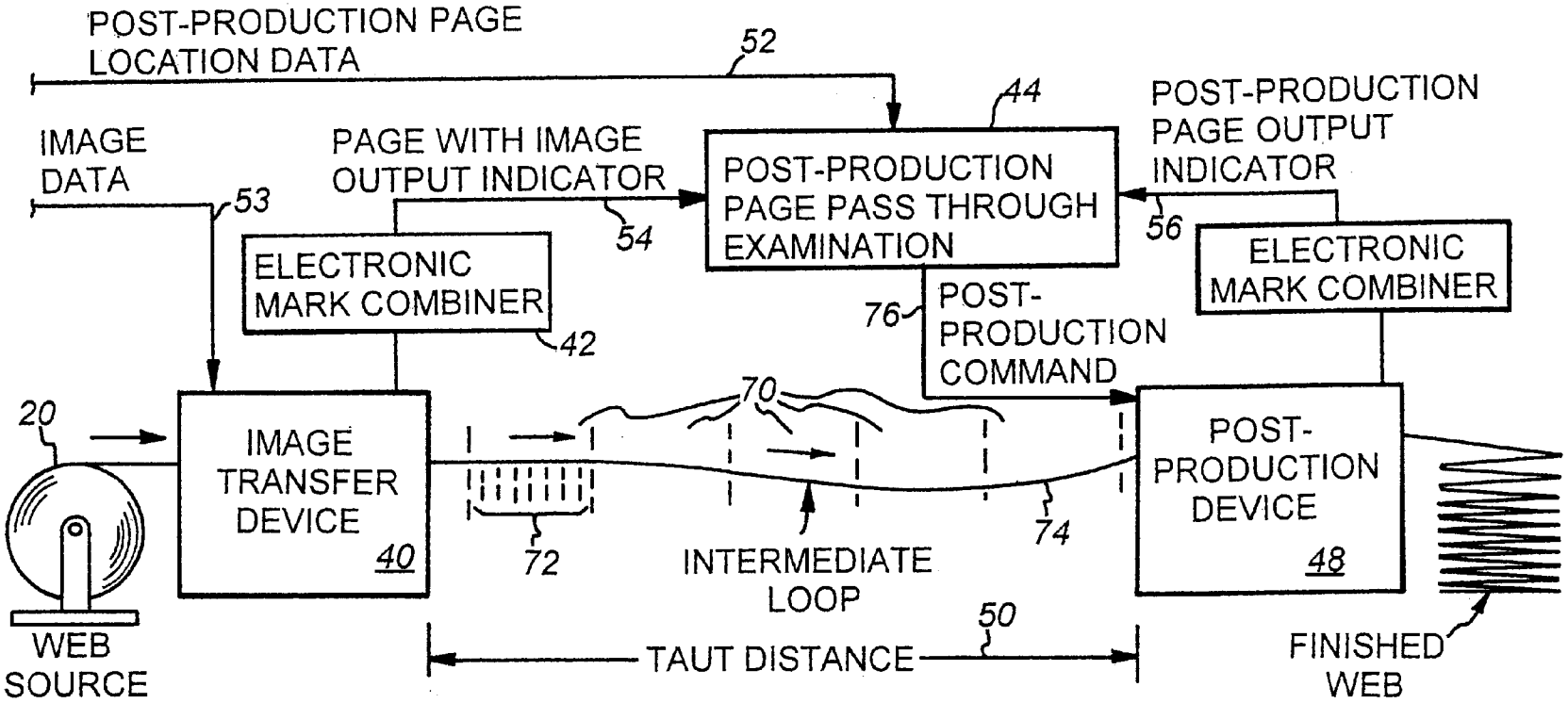
FIG. 1 is a schematic diagram of a system for incorporating post-production operations to a printed web according to this invention.

A system for incorporating a post-production operation to a printed web is depicted in FIG. 1. The system consists of a source of web 20 that is, for example, a paper material upon which printing is to be transferred. The web is thus fed to an image transfer device 40 that performs the printing process. A loop of web material 74 exits the image transfer device and enters a desired post-production device 48. This post-production device 48 performs an operation upon the web at various locations. This specific operation may be, for example, one of folding, cutting, application of further printing or hole punching. The length of web, when disposed tautly between the image transfer device and the post-production device, is known as the taut distance 50. This taut distance can be characterized in terms of predetermined intervals 72 of length as small as ⅛", or in terms of a given number of page lengths 70. Each page length generally corresponds to a given number of intervals 72.

Figure 7:
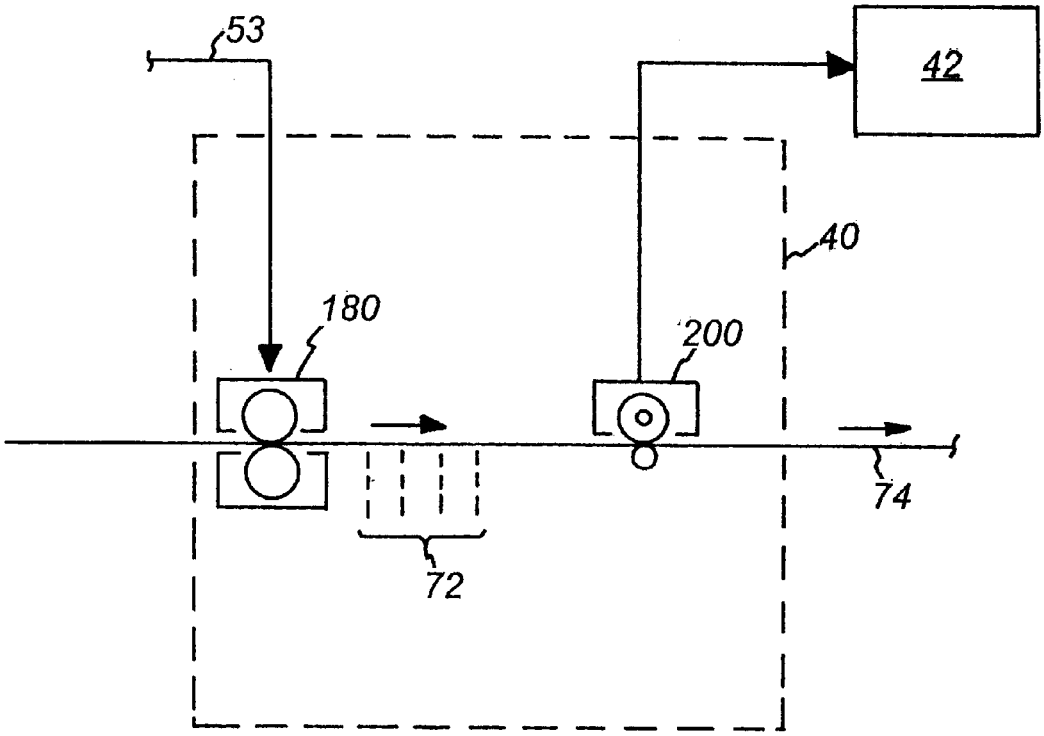
FIG. 7 is a schematic diagram of the electronic interval detector in the image transfer device of FIG. 1.

The image transfer device 40 contains an image transfer element 180 and contains a distance measurement device 200, as shown in FIG. 7, that measures the intervals 72 of length passing out of the image transfer device. These intervals of length are converted into corresponding electronic pulses or marks that are transmitted to a mark combiner 42.

This mark combiner translates the marks into a quantifiable increment, generally the length of a, page, and outputs data 54 indicating a page each time enough marks are combined to designate a page length of web passing through the image transfer device 40. The system quantifies measurements to page size to lessen the effects of rounding and truncation errors potentially resulting from discrete interval measurements.

After the web is fed from the image transfer device, it is carried over an intermediate loop 74 before again traveling into and out of the post-production device 48. Thus, a means for hand-shaking the operation of the image transfer device and the post-production device must be utilized if a page from the image transfer device is to be accurately processed by the post-production device. This hand-shake means is the system symbolized by the post-production pass through determination block 44 in FIG. 1. This determination system 44 is fed data 52 indicating which page should contain a post-production operation. The data 52 may be synchronized with data 53 controlling the image transfer device 40. When a page passes through the image transfer device 40 and a simultaneous signal for post-production 52 is sent to the determination system 44, the system 44 internally flags that page for a post-production operation.

Figure 8:
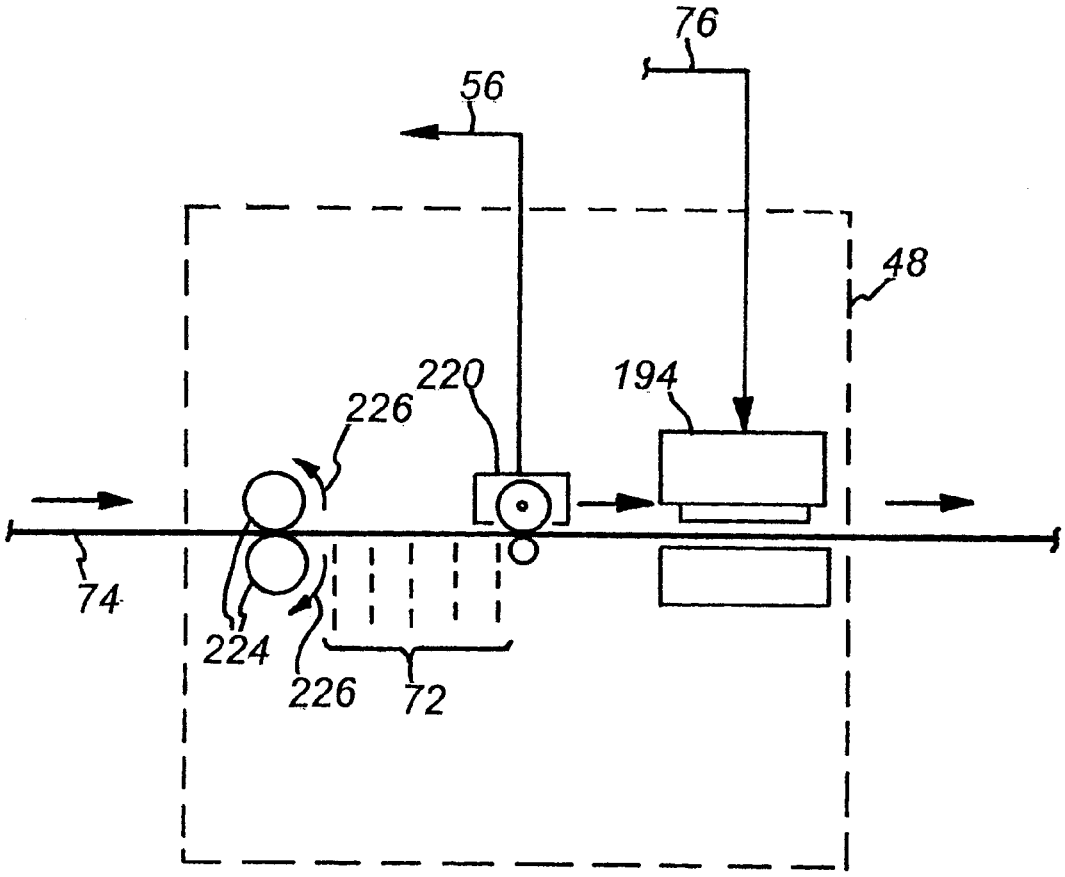
FIG. 8 is a schematic diagram of the electronic interval detector of the post-production device of FIG. 1.

The post-production device also reads pages passing through itself, as shown by the distance measuring element 220 in FIG. 8. The determination system 44 has the taut distance 50 programmed into it, so it determines how many pages must pass through the post-production device 48 for the flagged page from the image transfer device to reach the post-production device. It then counts off pages passing through the post-production device, using the post-production output indicator signal 56, to determine when the flagged page is present at the post-production device. At this point, the determination device transfers a post-production command 76 to the post-production device 48 to instruct the post-production device operational element 194, as shown in FIG. 8 to perform its operation.

Figure 2:
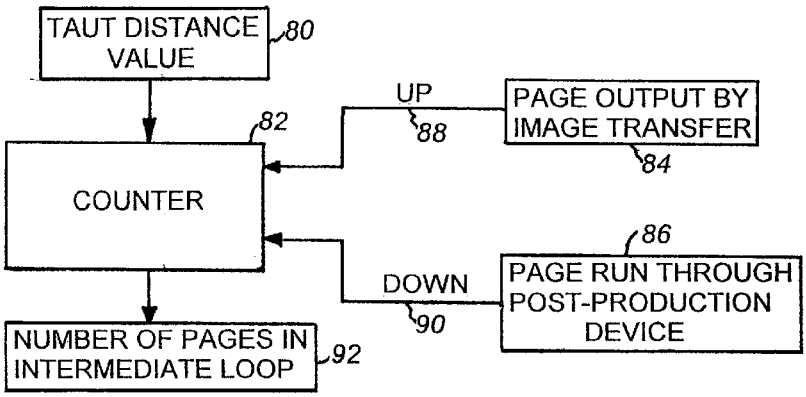
FIG. 2 is a block diagram showing the calculation of the number of pages in the intermediate loop for the post-production page pass through determination system of FIG. 1.

As illustrated, one important variable that must be known for the determination system 44 to accurately command an operation is the number of pages in the intermediate loop 74. If the image transfer device 40 and the post-production device 48 are initiated with a loop that is relatively taut and with both running at synchronized rates of web transfer, then the number of page lengths in the loop remain equal to the taut distance 50. However, it is sometimes the case, especially where independent and removable post-production units are utilized, that the two devices will run at slightly offset speeds. To account for this, FIG. 2 depicts a counter unit 82 that receives the taut distance value 80 and continually increments 88 or decrements 90 this initial value 80 based, respectively, upon each time a page is output by the image transfer device 84 or passed through the post-production device 86. In this way, an ongoing real-time calculation of total pages in the loop 92 is achieved.

Using this loop page number figure, the determination system 44 accurately gauges when a page arrives at the post-production device.

Figure 3:
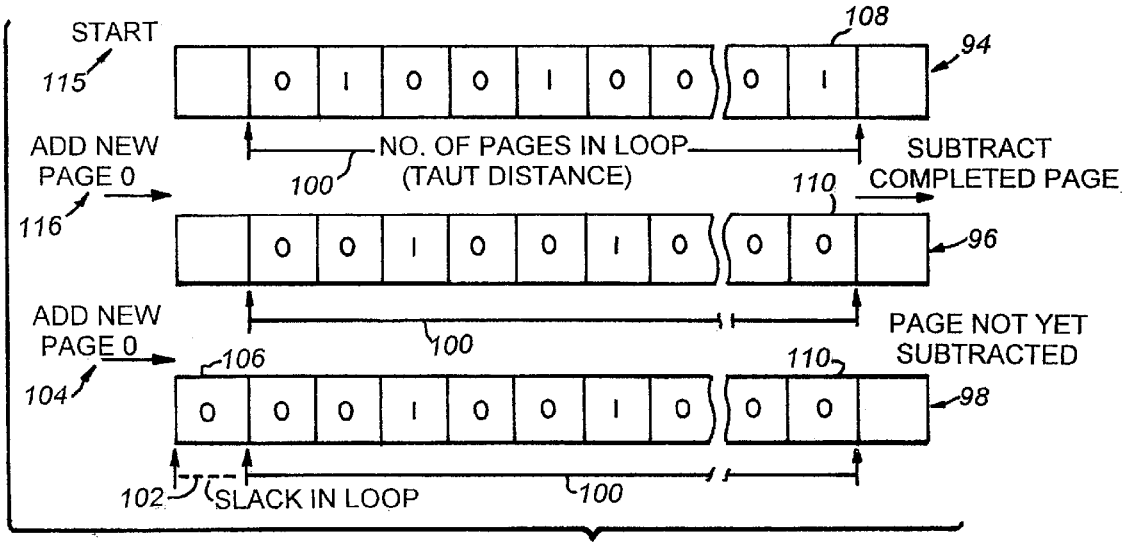
FIG. 3 is a sequence of three sequential diagrams of a shifting operation for the shift register used in the post-production page pass through determination system of FIG. 1.

The actual storage of post-production signals for pages disposed in the intermediate loop is depicted in three time frames in FIG. 3. The storage means consists of a shift register shown in a relative starting time frame 94. The shift register contains a number of shift locations equal to the number of pages in the loop 100. In the starting state 115, this number of pages 100 should equal the taut distance. In a simple embodiment, where one post-production device is utilized, each page in order of its appearance in the left-to-right loop from the image transfer device to the post-production device contains a number equal to either zero or one. Zero may represent no operation by the post-production device for that page location, while one represents that a post-production operation is to be performed.

The register 96 depicts the second time frame for the shift register in which a new page 116 has been added to the loop from the image transfer device. This new page holds a zero value, meaning no post-production operation is to be performed to it. At the same time, the post-production device has relatively synchronously transferred out a completed page. This page is shown in the previous time frame register having a one value 108 at the register end position. The determination system has read the last end value and commanded the post-production device to operate upon the page. The new end value 110 of the register 96 of the second time frame contains a zero value and, thus, shall have no post-production operation performed to it. All other zeros and ones in the register have been shifted one space. This process continues indefinitely, until all web images have been processed.

In the final time frame 98 of FIG. 3, another new page 104 has been added to the front of the register having a zero, non-post-production, value. However, the post-production device has not yet received and processed the last page designated by a zero in the end register 110. Thus, a slack 102 has developed in the loop. The counter means depicted in FIG. 2 will, therefore, be incremented without a nearly simultaneous decrement due to a page leaving the post-production device. The shift register then gains a value holding the new page instruction at the front of the register 106. When the post-production device again passes through a sheet, decrementing the counter, the shift register will disable the front location as the simultaneous shifting of all values in the register occurs.

Figure 4:
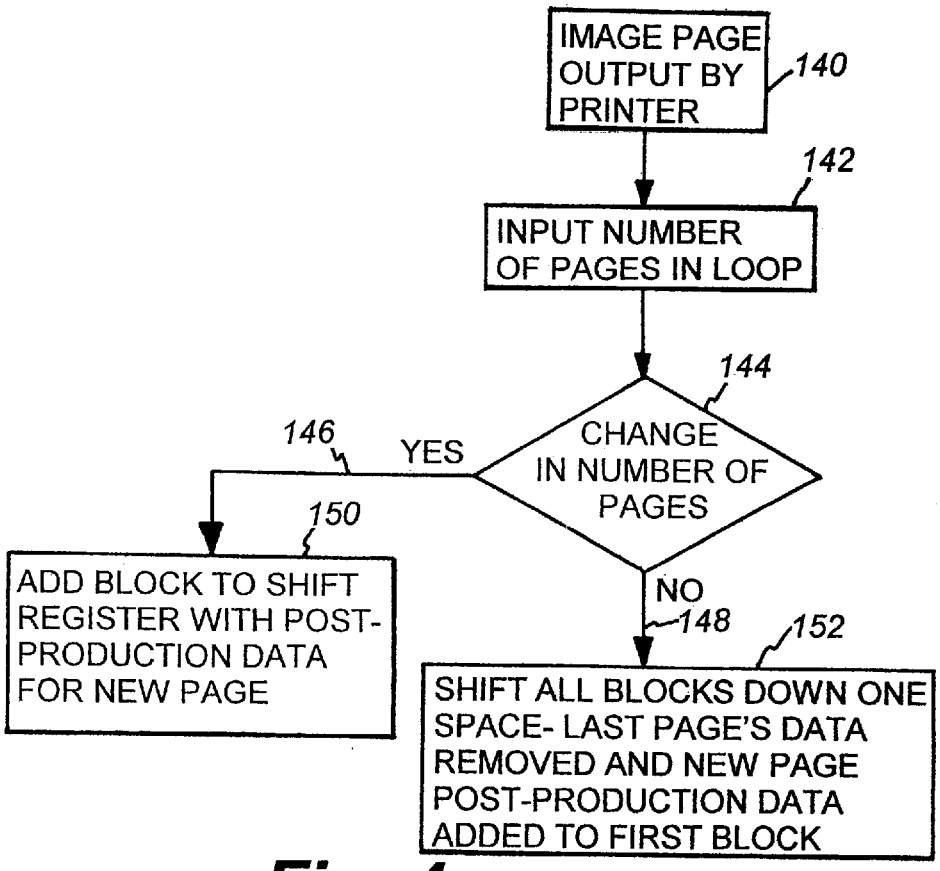
FIG. 4 is a block diagram of the shifting control process for the shift register of FIG. 3.

A general flow chart depicting this block adding operation of the shift register of FIG. 3 is shown in FIG. 4. The current number of pages in the loop 142 is input to a decision block 144 in response to the output of an image page by the image transfer unit 140. If the number of pages has increased 146, then a block is added to the shift register for storage of the new page data 150 and no shift occurs. Similarly, if the number of pages has not changed 148, then all blocks will be shifted down, and the new image page data, when ready, is added to the first block 152.

Figure 5:
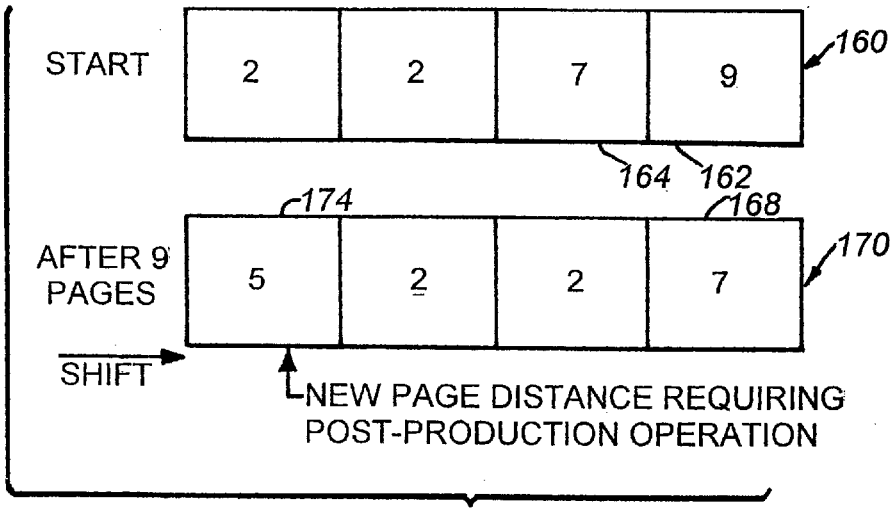
FIG. 5 is a sequence of three sequential diagrams of an alternative incremental distance storage register system for use with the post-production page pass through determination system of FIG. 1.

The above embodiment generally involves the storage of a piece of data corresponding to each page in the intermediate loop 74 between the image transfer device 40 and the post-production device 48. As each page is shifted down the loop, the data of the shift register means is also shifted with new page data added at the front and old page data read for commands and dropped off at the rear of the register, just as the pages in the loop themselves enter and leave. An alternative means for storage of data corresponding to pages in the loop is depicted in FIG. 5. This means stores the number of pages disposed between the post-production pages rather than a single data value for each page. The last storage block 162 in the register 160 at the exemplified starting state depicts nine pages until the next post-production page will appear at the post-production means. Once nine pages have moved through the post-production unit, the operation will then be performed to that ninth page. All the storage blocks will then be shifted, as shown by the second register 170, such that the second-to-last block 164 in the starting register 160 is now the new last end block upon which the determining system 44 bases its count of identified pages 56 from the post-production unit for the next post-production operation 168. In this exemplified register 170, the number of pages until the next post-production operation is seven.

At a point in time when a new post-production page enters the loop, based upon signals 52 and 53 shown in FIG. 1, the next incremental page distance value 174 is placed at the front of the storage register. Generally, this system requires fewer storage blocks than the shift register system of the embodiment of FIG. 3. However, it is possible that, if a post-production operation must be performed it each page within the loop, as many storage locations are required as for the shift register system of FIG. 3. The creation of additional storage blocks may be accomplished in this type of system with a counter that detects pages in the loop.

Figure 6:
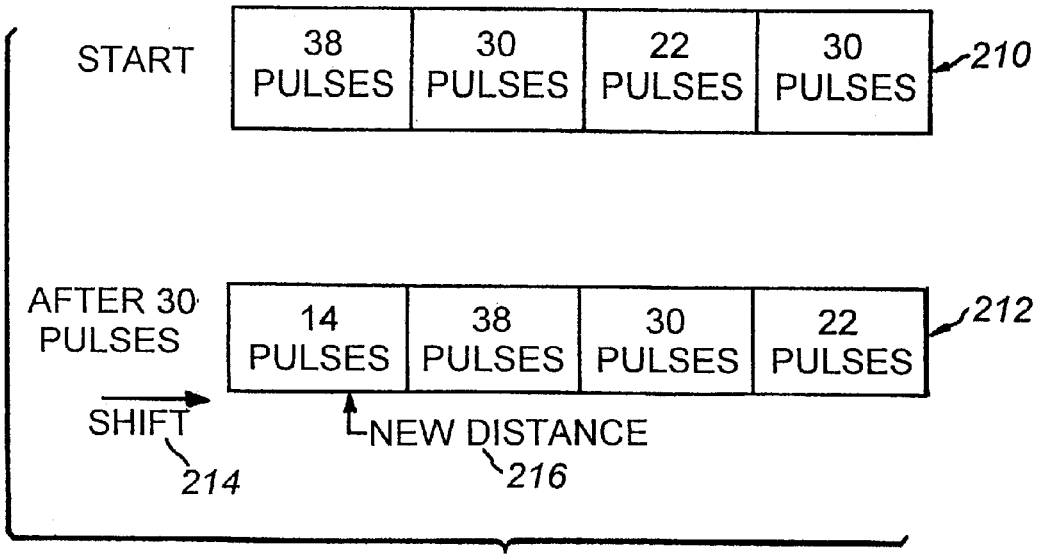
FIG. 6 is a sequence of three sequential diagrams of an alternative absolute distance storage register for use with the post-production page pass through determination system of FIG. 1.

An advantage of the second storage embodiment is more clearly prevalent in FIG. 6. Here, absolute distance consisting of the number of pulses between post-production operations is stored rather than numbers of pages. This system depicts a storage register 210 at a starting time and then at a time 212 after 30 pulses have been counted off by the post-production device wherein a shift 214 has occurred and a new distance of 14 pulses has been added to the front of the register 216. An advantage of using pulses directly from the distance measuring devices 200 of FIG. 7 and 220 of FIG. 8 is that post-production operations can be more accurately pinpointed to specific variable locations upon each page as designated by a specified number of pulses, rather than simply at the page. Furthermore, since post-production operations are located relative to an absolute distance measurement rather than an arbitrary preprogrammed page measurement, pages of varying length may be easily included in the same web. Note that FIG. 8 includes a pair of drive rollers 224 that rotate (arrows 226) to drive the web 74 through the post-production device 48.

In any of the above embodiments, several post-production devices may be included and a multiplicity of types signals may be shifted by the storage means in order to perform one or more selectable types of post-production operations. These different operations may each be performed upon the same or upon differing pages within the web.

It should be understood that the preceding is merely a detailed description of a preferred embodiment. It will be obvious to those skilled in the art that various modifications can be made without departing from the spirit or scope of the invention. The preceding description is meant to describe only a preferred embodiment and not to limit the scope of the invention.

What is claimed is:

1. A system for tracking a web moving in a downstream direction in web loop from a first web utilization device to a second web utilization device, the loop having a variable length, the system comprising:

a first movement sensor for sensing movement of predetermined length increments of web passing through the first web utilization device;

a second movement sensor for sensing movement of predetermined length increments of web passing through the second web utilization device;

a storage register that stores a plurality of values in a sequence from a sequence beginning to a sequence end relative to and in order of a number of predetermined increments of web in the loop frown an upstream location to a downstream location, the values each corresponding to a predetermined operation on the web to be performed by the second web utilization device;

a controller, being constructed and arranged to place values corresponding to predetermined operations on the web by the second utilization device in the storage register at the sequence end as predetermined length increments of web pass through the first web utilization device, and being constructed and arranged to read a beginning of the sequence to determine the value stored therein as predetermined length increments of web pass through the second web utilization device; and the controller being further constructed and arranged to move the beginning of the sequence to an adjacent, upstream value in the storage register when the predetermined length increments pass through the second web utilization device so that a value corresponding to a next location on the web loop is read when the next location enters the second web utilization device.

2. The system as set forth in claim 1 wherein the register comprises a shift register that stores discrete values corresponding to selected operations by the second web utilization device.

3. A method for tracking a web moving in a downstream direction in web loop from a first web utilization device to a second web utilization device, the web loop having a variable length, the method comprising:

sensing movement of predetermined length increments of web passing through the first web utilization device;

sensing movement of predetermined length increments web passing through the second web utilization device;

storing a plurality of values in a sequence from a sequence beginning to a sequence end relative to and in order of a number of the length increments of web in the loop from an upstream location to a downstream location, the values each corresponding to a predetermined operation on the web to be performed by the second web utilization device;

placing values corresponding to predetermined operations on the web by the second utilization device in a storage register at the sequence end as predetermined length increments of web pass through the first web utilization device, and reading a beginning of the sequence to determine the value stored therein as predetermined length increments of web pass through the second web utilization device; and moving the beginning of the sequence to an adjacent, upstream value in the storage register when the predetermined length increments pass through the second web utilization device so that a value corresponding to a next location on the web loop is read when the next location enters the second web utilization device.

4. The method as set forth in claim 3 wherein the step of placing values corresponding to predetermined operations on the web by the second utilization device in the storage register comprises placing the values in a shift register that stores discrete values corresponding to selected operations by the second web utilization device.

* * * * *